US007784118B2

(12) United States Patent
Lee

(10) Patent No.: US 7,784,118 B2
(45) Date of Patent: Aug. 31, 2010

(54) LOWER BODY SAUNA DEVICE

(76) Inventor: Seung Woo Lee, 18-tong, 4-ban, 199-1 Sungsan 1-dong, Mapo-ku, Seoul (KR)

( * ) Notice: Subject to any disclaimer, the term of this patent is extended or adjusted under 35 U.S.C. 154(b) by 1121 days.

(21) Appl. No.: 11/447,620

(22) Filed: Jun. 6, 2006

(65) Prior Publication Data

US 2007/0277303 A1 Dec. 6, 2007

(51) Int. Cl.
*A61H 33/06* (2006.01)

(52) U.S. Cl. ..... 4/531; 4/524

(58) Field of Classification Search ..... 4/524, 4/528–532

See application file for complete search history.

(56) References Cited

U.S. PATENT DOCUMENTS

| | | | | | |
|---|---|---|---|---|---|
| 264,797 | A | * | 9/1882 | Tschiember | 4/532 |
| 492,740 | A | | 2/1893 | Copeland | |
| D30,772 | S | | 5/1899 | Nichols | |
| 1,718,770 | A | * | 6/1929 | Zublin | 607/91 |
| 2,041,852 | A | * | 5/1936 | Metzger | 4/531 |
| 2,578,067 | A | | 12/1951 | Jensen | |
| 2,632,619 | A | | 3/1953 | Wilson | |
| 2,721,680 | A | | 10/1955 | Steckman | |
| 2,826,206 | A | | 3/1958 | Slater | |
| 3,009,165 | A | * | 11/1961 | Washam et al. | 4/524 |
| 3,295,732 | A | | 1/1967 | Haven | |
| D227,742 | S | | 7/1973 | Logsdon | |
| D239,592 | S | | 4/1976 | Anderson | |
| D241,314 | S | | 9/1976 | Hug | |
| D250,631 | S | | 12/1978 | Stephenson | |
| D284,294 | S | | 6/1986 | Upton | |
| 4,607,772 | A | | 8/1986 | Hancock | |
| D296,074 | S | | 6/1988 | Seyfarth | |
| D299,213 | S | | 1/1989 | Puntillo | |
| D299,247 | S | | 1/1989 | Shepard | |
| 4,823,673 | A | | 4/1989 | Downing | |
| D306,553 | S | | 3/1990 | Rumpel | |
| D322,200 | S | | 12/1991 | Pierce | |
| 5,178,413 | A | | 1/1993 | King | |
| 5,346,165 | A | | 9/1994 | Frean et al. | |
| 5,360,190 | A | | 11/1994 | Walker et al. | |
| D366,609 | S | | 1/1996 | McDonald | |
| D375,453 | S | | 11/1996 | Fleck | |
| D377,383 | S | | 1/1997 | Morocco | |
| D378,439 | S | | 3/1997 | Gary et al. | |
| 5,609,415 | A | | 3/1997 | Protz, Jr. | |
| 5,615,903 | A | | 4/1997 | Spear et al. | |
| D386,304 | S | | 11/1997 | Hancock | |
| 5,697,181 | A | | 12/1997 | Savant | |

(Continued)

*Primary Examiner*—Huyen Le
(74) *Attorney, Agent, or Firm*—John K Park; Park Law Firm

(57) ABSTRACT

A lower body sauna device includes a heat chamber that is adapted to enclose the lower body of a user, and an infrared heater provided inside the heat chamber. The heat chamber includes an elliptically shaped body opening that is adapted to fit the waist of the user, and the size of which is adjustable. The top slab includes a sliding top panel and a fixed top panel. The body opening includes a first elliptical half opening provided on the sliding top panel, and a second elliptical half opening provided on the fixed top panel. The sliding top panel is adapted to slide to an away from the fixed top panel so that the size of the body opening is adjusted.

14 Claims, 3 Drawing Sheets

U.S. PATENT DOCUMENTS

| | | | | |
|---|---|---|---|---|
| D390,101 | S | | 2/1998 | Nygards |
| D400,064 | S | | 10/1998 | Tellez |
| 5,915,572 | A | | 6/1999 | Hancock |
| 5,957,352 | A | | 9/1999 | Gares |
| D417,612 | S | | 12/1999 | Jones |
| D421,318 | S | | 2/2000 | O'Brien et al. |
| 6,029,874 | A | | 2/2000 | Meggitt |
| D435,284 | S | | 12/2000 | Sutula |
| 6,157,005 | A | * | 12/2000 | Lu ..... 219/400 |
| 6,186,383 | B1 | | 2/2001 | Kobdish |
| 6,189,753 | B1 | | 2/2001 | Kalhok et al. |
| D440,625 | S | | 4/2001 | Cook, Jr. |
| 6,484,913 | B1 | | 11/2002 | Hancock et al. |
| D470,937 | S | | 2/2003 | Gary et al. |
| 6,588,637 | B2 | | 7/2003 | Gates et al. |
| 6,626,339 | B2 | | 9/2003 | Gates et al. |
| 6,626,423 | B2 | | 9/2003 | Doswell |
| D481,930 | S | | 11/2003 | Hein |
| 6,695,183 | B2 | | 2/2004 | Hancock et al. |
| 6,902,089 | B2 | | 6/2005 | Carnevali |
| 2002/0060232 | A1 | | 5/2002 | Stenger et al. |
| 2003/0000981 | A1 | | 1/2003 | Gates et al. |
| 2003/0042283 | A1 | | 3/2003 | Carnevali |
| 2003/0168484 | A1 | | 9/2003 | Gates et al. |

* cited by examiner

LOWER BODY SAUNA DEVICE

BACKGROUND OF THE INVENTION

The present invention relates to a sauna device. More particularly, the invention relates to a sauna device that is adapted for bathing lower half of the human body.

In Asia and Europe, the practice of "Half Bath" (immersing the lower half of body in hot or warm water) has been known or believed to have many health benefits. The core idea behind "Half Bath" is to keep the lower half of body warm and the upper half of body cool. By doing so, circulation of blood is improved and excess toxins are purged out, thus promoting improvement in overall health condition.

Even though many people realize and believe in the benefits of "Half Bath", they find "Half Bath" to be inconvenient in several ways. First, it is time consuming to wait for enough water to gather in your tub. Second, it is not economical as you continue to have to add hot water to maintain appropriate-water temperature. Third, it is inconvenient to do anything else while sitting in the tub for 30 to 40 minutes at a time. Not to mention that it becomes mundane and boring.

There has long been a need for a convenient device that facilitates the half bath.

SUMMARY OF THE INVENTION

An object of the invention is to provide a compact and easy-to-maintain device for half bath.

Another object of the invention is to provide a portable device for half bath.

Still another object of the invention is to provide an energy-saving device for half bath.

To achieve the above-described objects, the present invention provide a lower body sauna device that includes a heat chamber that is adapted to enclose the lower body of a user, and a heater provided inside the heat chamber. The heat chamber includes a body opening that is adapted to fit the waist of the user.

The body opening has elliptical shape, and the size of the body opening is adjustable.

The heater generates infrared ray.

The lower body sauna device further includes a controller, which is installed outside the heat chamber. The controller controls the temperature inside the heat chamber and duration of the operation of the heater.

The heat chamber includes a seat, which is positioned inside the heat chamber and below the body opening. The seat includes a seat slot for heated air circulation, and the heater is provided below the seat. The seat includes a back support. The back support includes a back slot for heated air circulation.

The heat chamber includes a top slab, a bottom slab and a side wall that connects the top slab and the bottom slab. The body opening is provided on the top slab. The controller is provided on the top slab.

The top slab includes a sliding top panel and a fixed top panel. The body opening has elliptical shape. The body opening includes a first elliptical half opening provided on the sliding top panel, and a second elliptical half opening provided on the fixed top panel.

The sliding top panel includes a first sliding panel and a second sliding panel. The first sliding panel and the second sliding panel are connected with a hinge so that the second sliding panel can be pivoted upward with respect to the first sliding panel. The first elliptical half opening is provided on the second sliding panel.

The sliding top panel is adapted to slide to an away from the fixed top panel so that the size of the body opening is adjusted.

The side wall includes an access door. The access door is positioned near the seat. The seat includes a slanted portion that is provided adjacent the access door.

The lower body sauna device has substantially a shape of a rectangular parallelepiped. The lower body sauna device further includes a slanted wall, which is provided near the top slab and opposite to the seat.

The lower body sauna device further includes a plurality of casters, so that the lower body sauna device is movable.

The advantages of the present invention are: (1) since the lower body sauna device uses infrared heaters so that there is no need for water; (2) the lower body sauna device can be placed anywhere inside the house; (3) the lower body sauna device can be easily transported from one place to another with the attached wheels; (4) a user can utilize the "Half Bath" time more efficiently by reading a book, watching TV or working with a laptop computer; and (5) the lower body sauna device is economical and environment-friendly as it uses less energy and there is no need to waste water unnecessarily.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
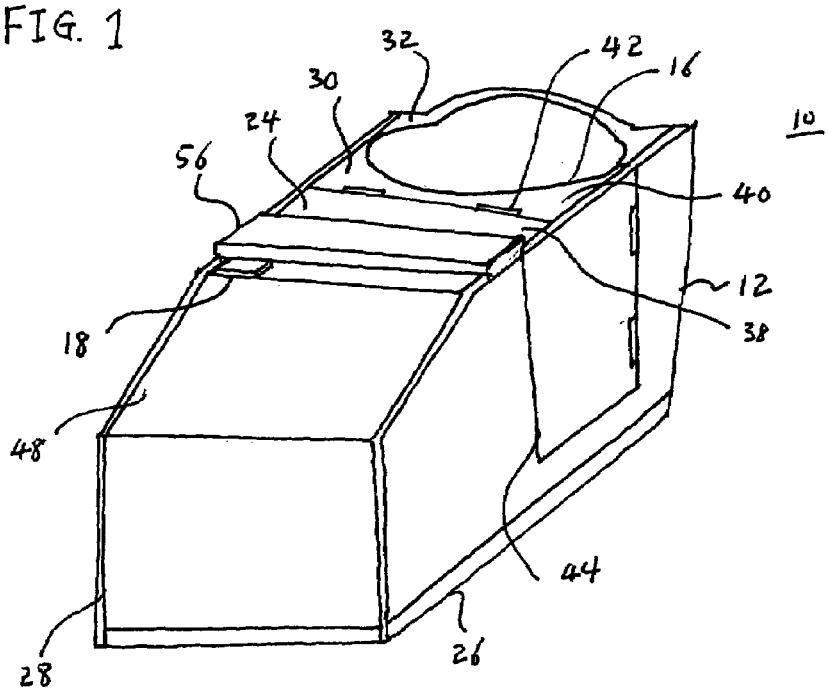
FIG. 1 is a perspective view of a lower body sauna device of the present invention.
Figure 2:
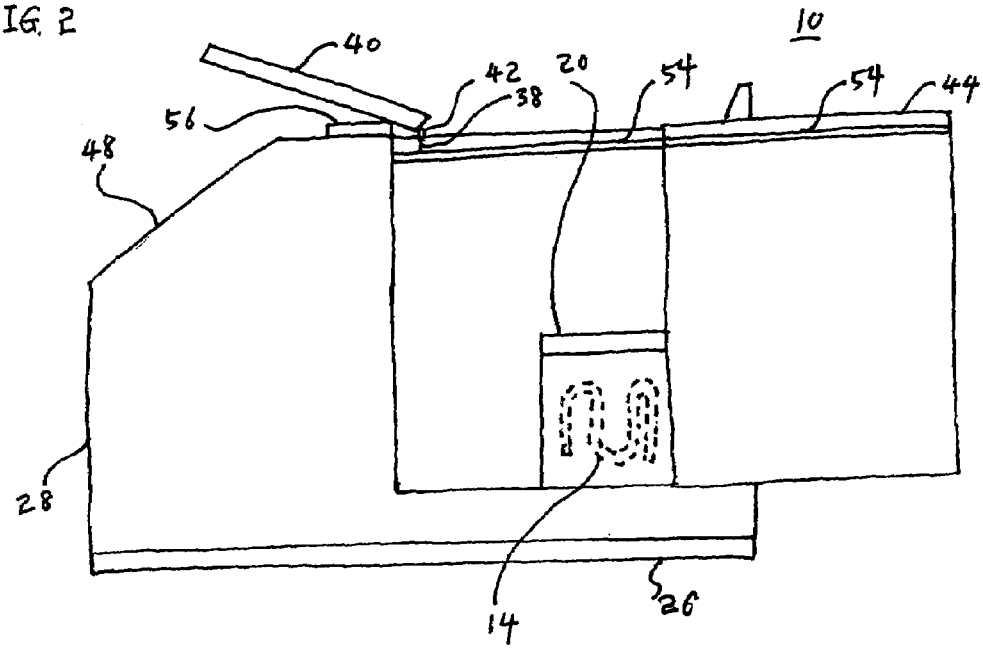
FIG. 2 is a front elevation view of the lower body sauna device with an access door swung open and a to slab swung open.

FIGS. 1 and 2 show a lower body sauna device 10 according to the present invention. The lower body sauna device 10 includes a heat chamber 12 that is adapted to enclose the lower body of a user, and a heater 14 provided inside the heat chamber 12. The heat chamber 12 includes a body opening 16 that is adapted to fit the waist of the user.

The body opening 16 has elliptical shape, and the size of the body opening 16 is adjustable.

The heater 12 generates infrared ray, and is electrically powered.

Figure 3:
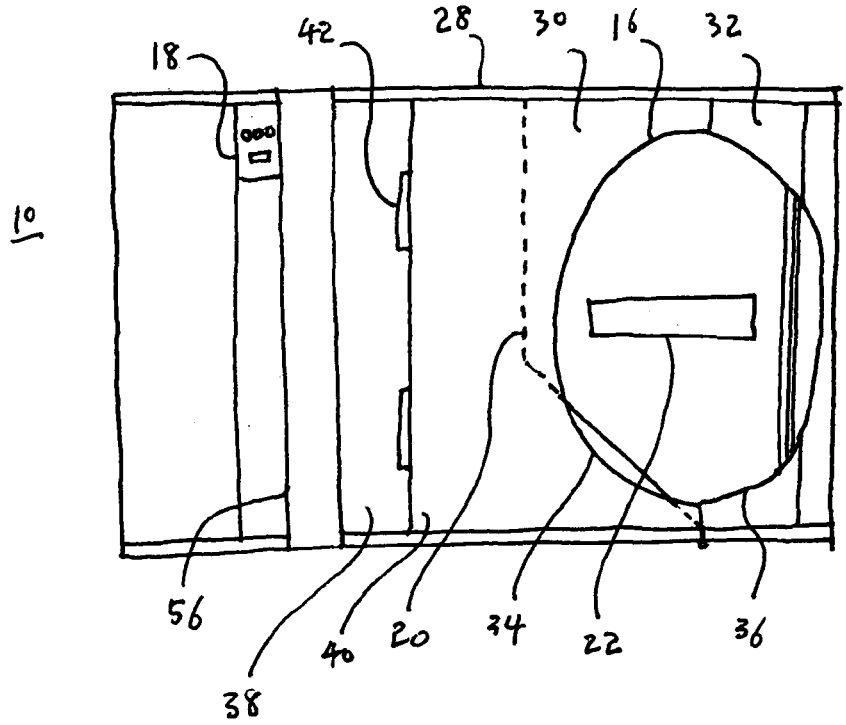
FIG. 3 is a plan view of the lower body sauna device.

FIG. 3 shows that the lower body sauna device 10 further includes a controller 18, which is installed outside the heat chamber 12. The controller 18 controls the temperature inside the heat chamber 12 and duration of the operation of the heater 14.

Figure 4:
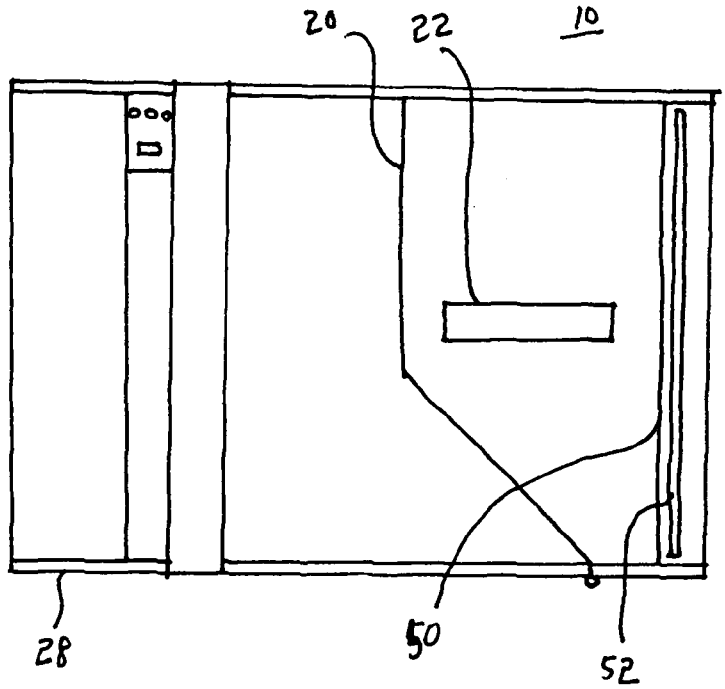
FIG. 4 is a plan view of the lower body sauna device with the top slab not shown.

FIGS. 2 and 4 show that the heat chamber 12 includes a seat 20, which is positioned inside the heat chamber 12 and below the body opening 16. The seat includes a seat slot 22 for heated air circulation, and the heater 14 is provided below the seat 20. The seat includes a back support 50. The back support 50 includes a back slot 52 for heated air circulation. The seat provides a safe and space-efficient place to enclose the heater 14.

The heat chamber 12 includes a top slab 24, a bottom slab 26 and a side wall 28 that connects the top slab 24 and the bottom slab 26. The body opening 16 is provided on the top slab 24. The controller 18 is provided on the top slab 24.

The top slab 24 includes a sliding top panel 30 and a fixed top panel 32. The body opening 16 has elliptical shape. The body opening 16 includes a first elliptical half opening 34 provided on the sliding top pane 30, and a second elliptical half opening 36 provided on the fixed top panel 32.

The sliding top panel 30 includes a first sliding panel 38 and a second sliding panel 40. The first sliding panel 38 and the second sliding panel 40 are connected with a hinge 42 so that the second sliding panel 40 can be pivoted upward with respect to the first sliding panel 38. The first elliptical half opening 34 is provided on the second sliding panel 40.

The sliding top panel 30 is adapted to slide to an away from the fixed top panel 32 so that the size of the body opening 16 is adjusted.

The side wall 28 includes an access door 44. The access door 44 is positioned near the seat 20. The seat 20 includes a slanted portion 46 that is provided adjacent the access door 44. The slated portion 46 facilitates entry of a user into the heat chamber 12.

The sliding top panel 30 slides on rails 54 provided on the access door 44 and the side wall 28. A cross bar 56 limits upward movement the sliding top panel 30 and provides structural reinforcement.

The lower body sauna device 10 has substantially a shape of a rectangular parallelepiped. The lower body sauna device 10 further includes a slanted wall 48, which is provided near the top slab 24 and opposite to the seat 20. The slanted wall 48 helps to reduce the size of the heat chamber 12 while providing a comfortable space to the user.

Figure 5:
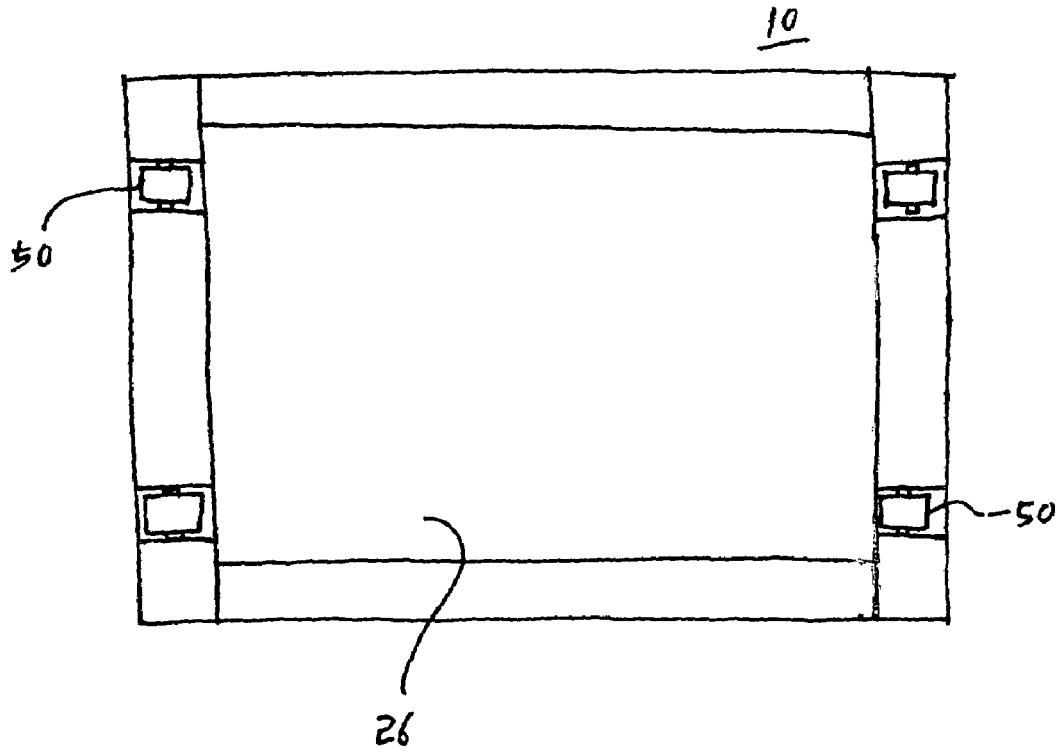
FIG. 5 is a bottom view of the lower body sauna device.

FIG. 5 shows that the lower body sauna device 10 further includes a plurality of casters 50, so that the lower body sauna device 10 is movable with manual force.

A method of using the lower body sauna device 10 is explained.

A user first Step into the lower body sauna device 10 with the access door 44 open. The user sits on the seat 20 and closes the access door 44. The user closes the top slab 24 and adjusts the size of the body opening 16 to fit user's waist comfortably. This is done to minimize heat loss and maximize efficiency. The user turns on the lower body sauna device and sets desired time and temperature with the controller 18.

The lower body sauna device is built with high quality wood such as the highest quality Canadian Western Red Cedar to enhance its natural beauty and durability.

Although the invention has been described in considerable detail, other versions are possible by converting the aforementioned construction. Therefore, the scope of the invention shall not be limited by the specification specified above.

What is claimed is:

1. A lower body sauna device comprising:

a) a heat chamber that is adapted to enclose the lower body of a user; and b) a heater provided inside the heat chamber;

wherein the heat chamber comprises a body opening that is adapted to fit the waist of the user;

wherein the heat chamber comprises a top slab, a bottom slab and a side wall that connects the top slab and the bottom slab, wherein the body opening is provided on the top slab;

wherein the top slab comprises a sliding top panel and a fixed top panel;

wherein the body opening has elliptical shape, wherein the body opening comprises a first elliptical half opening provided on the sliding top panel, and a second elliptical half opening provided on the fixed top panel; and wherein the sliding top panel comprises a first sliding panel and a second sliding panel, wherein the first sliding panel and the second sliding panel are connected with a hinge whereby the second sliding panel can be pivoted upward with respect to the first sliding panel, wherein the first elliptical half opening is provided on the second sliding panel.

2. The lower body sauna device of claim 1, wherein the lower body sauna device has substantially a shape of a rectangular parallelepiped.

3. The lower body sauna device of claim 1, further comprising a slanted wall, wherein the slanted wall is provided near the top slab and opposite to the seat.

4. The lower body sauna device of claim 1, further comprising a plurality of casters, whereby the lower body sauna device is movable.

5. The lower body sauna device of claim 1, wherein the heater generates infrared ray.

6. The lower body sauna device of claim 1, further comprising a controller, wherein the controller is installed outside the heat chamber, wherein the controller controls the temperature inside the heat chamber and duration of the operation of the heater.

7. The lower body sauna device of claim 1, wherein the seat comprises a seat slot for heated air circulation.

8. A lower body sauna device comprising:

a) a heat chamber that is adapted to enclose the lower body of a user; and b) a heater provided inside the heat chamber;

wherein the heat chamber comprises a body opening that is adapted to fit the waist of the user;

wherein the heat chamber comprises a top slab, a bottom slab and a side wall that connects the top slab and the bottom slab, wherein the body opening is provided on the top slab;

wherein the top slab comprises a sliding top panel and a fixed top panel;

wherein the body opening has elliptical shape, wherein the body opening comprises a first elliptical half opening provided on the sliding top panel, and a second elliptical half opening provided on the fixed top panel;

wherein the sliding top panel is adapted to slide to an away from the fixed top panel whereby the size of the body opening is adjusted;

wherein the heat chamber comprises a seat, wherein the seat is positioned inside the heat chamber and below the body opening, wherein the side wall comprises an access door, wherein access door is positioned near the seat, wherein the seat comprises a slanted portion that is provided adjacent to the access door; and wherein opening the access door and sliding the sliding top panel provide room for a user to enter the lower body sauna device.

9. The lower body sauna device of claim 8, wherein the lower body sauna device has substantially a shape of a rectangular parallelepiped.

10. The lower body sauna device of claim 8, further comprising a slanted wall, wherein the slanted wall is provided near the top slab and opposite to the seat.

11. The lower body sauna device of claim 8, further comprising a plurality of casters, whereby the lower body sauna device is movable.

12. The lower body sauna device of claim 8, wherein the heater generates infrared ray.

13. The lower body sauna device of claim 8, further comprising a controller, wherein the controller is installed outside the heat chamber, wherein the controller controls the temperature inside the heat chamber and duration of the operation of the heater.

14. The lower body sauna device of claim 8, wherein the seat comprises a seat slot for heated air circulation.

* * * * *